US009288885B2

(12) United States Patent
Hu

(10) Patent No.: US 9,288,885 B2
(45) Date of Patent: Mar. 15, 2016

(54) ELECTRICAL POWER CONTROL OF A FIELD EMISSION LIGHTING SYSTEM

(75) Inventor: Qiu-Hong Hu, Göteborg (SE)

(73) Assignee: LIGHTLAB SWEDEN AB, Stockholm (SE)

( * ) Notice: Subject to any disclaimer, the term of this patent is extended or adjusted under 35 U.S.C. 154(b) by 204 days.

(21) Appl. No.: 13/989,200

(22) PCT Filed: Dec. 7, 2011

(86) PCT No.: PCT/EP2011/072060

§ 371 (c)(1),
(2), (4) Date: Sep. 3, 2013

(87) PCT Pub. No.: WO2012/089468

PCT Pub. Date: Jul. 5, 2012

(65) Prior Publication Data

US 2014/0062335 A1 Mar. 6, 2014

(30) Foreign Application Priority Data

Dec. 28, 2010 (EP) ..... 10197168

(51) Int. Cl.

| | |
|---|---|
| ***H01J 31/12*** | (2006.01) |
| ***H05B 41/36*** | (2006.01) |
| ***H01J 1/304*** | (2006.01) |
| ***H01J 61/52*** | (2006.01) |

(Continued)

(52) U.S. Cl.

CPC ..... *H05B 41/36* (2013.01); *H01J 1/304* (2013.01); *H01J 61/523* (2013.01); *H01J 63/02* (2013.01); *H01J 63/04* (2013.01); *H01J 63/06* (2013.01)

(58) Field of Classification Search

CPC ..... H01J 31/127; H01J 1/304; H01J 63/02; H01J 9/025; H01J 29/04

USPC ..... 313/496

See application file for complete search history.

(56) References Cited

U.S. PATENT DOCUMENTS

| | | | | |
|---|---|---|---|---|
| 2,907,909 | A | 10/1959 | Kazuk | |
| 7,141,923 | B2 * | 11/2006 | Song et al. | 313/497 |

(Continued)

FOREIGN PATENT DOCUMENTS

| | | |
|---|---|---|
| EP | 1870925 A2 | 12/2007 |
| EP | 2079095 A | 7/2009 |

(Continued)

OTHER PUBLICATIONS

PCT International Search Report and Written Opinion mailed Feb. 21, 2012 for International Application No. PCT/EP2011/072060, filed Dec. 7, 2011 (16 pages).

*Primary Examiner* — John Poos

(74) *Attorney, Agent, or Firm* — Remarck Law Group PLC

(57) ABSTRACT

The present invention relates to a field emission lighting arrangement, comprising an anode structure at least partly covered by a phosphor layer, an evacuated envelope inside of which an anode structure is arranged, and a field emission cathode, wherein the field emission lighting arrangement is configured to receive a drive signal for powering the field emission lighting arrangement and to sequentially activate selected portions of the phosphor layer for emitting light. The same control regime may be applied to an arrangement comprising a plurality of field emission cathodes and a single field emission anode. Advantages with the invention includes increase lifetime of the field emission lighting arrangement.

14 Claims, 2 Drawing Sheets

(51) Int. Cl.

| | |
|---|---|
| ***H01J 63/02*** | (2006.01) |
| ***H01J 63/04*** | (2006.01) |
| ***H01J 63/06*** | (2006.01) |

(56) References Cited

U.S. PATENT DOCUMENTS

| | | | |
|---|---|---|---|
| 2004/0027050 | A1 | 2/2004 | Rasmussen |
| 2005/0052116 | A1 | 3/2005 | Yaguchi et al. |
| 2008/0100235 | A1 | 5/2008 | Lin et al. |

FOREIGN PATENT DOCUMENTS

| | | | |
|---|---|---|---|
| JP | 2008016308 | A | 1/2008 |
| WO | 9857345 | A | 12/1998 |

* cited by examiner

ELECTRICAL POWER CONTROL OF A FIELD EMISSION LIGHTING SYSTEM

CROSS-REFERENCE TO RELATED APPLICATIONS

This application is a 371 U.S. National Stage of International Application No. PCT/EP2011/072060, filed Dec. 7, 2011, which claims priority to EPC No. 10197168.7, filed Dec. 28, 2010. The disclosure of each of the above applications is incorporated herein by reference in their entirety.

TECHNICAL FIELD

The present invention relates to a field emission lighting arrangement. More specifically, the invention relates to a field emission lighting arrangement where selected portions of a phosphor layer are sequentially activated for emitting light. The invention also relates to a corresponding field emission lighting system.

BACKGROUND OF THE INVENTION

There is currently a trend in replacing the traditional light bulb with more energy efficient alternatives. Florescent light sources also in forms resembling the traditional light bulb have been shown and are often referred to as compact fluorescent lamps (CFLs). As is well known, all florescent light sources contain a small amount of mercury, posing problems due to the health effects of mercury exposure. Additionally, due to heavy regulation of the disposal of mercury, the recycling of florescent light sources becomes complex and expensive.

Accordingly, there is a desire to provide an alternative to florescent light sources. An example of such an alternative is provided in WO2005074006, disclosing a field emission light source containing no mercury or any other health hazardous materials. The field emission light source includes an anode and a cathode, the anode consists of a transparent electrically conductive layer and a layer of phosphors coated on the inner surface of a cylindrical glass tube. The phosphors are luminescent when excited by electrons. The electron emission is caused by a voltage between the anode and the cathode. For achieving high emission of light it is desirable to apply the voltage in a range of 4-12 kV.

The field emission light source disclosed in WO2005074006 provides a promising approach to more environmentally friendly lighting, e.g. as no use of mercury is necessary. However it is always desirable to improve the design of the lamp to prolong the life time, and/or to increase the luminous efficiency of the lamp.

SUMMARY OF THE INVENTION

According to an aspect of the invention, the above is at least partly met by a field emission lighting arrangement, comprising an anode structure at least partly covered by a phosphor layer, an evacuated envelope inside of which an anode structure is arranged, and a field emission cathode, wherein the field emission lighting arrangement is configured to receive a drive signal for powering the field emission lighting arrangement and to sequentially activate selected portions of the phosphor layer for emitting light.

Prior art field emission lighting arrangements are generally configured such that, during operation, the cathode emits electrons, which are accelerated toward the complete phosphor layer of the field emission lighting arrangement. The phosphor layer may provide luminescence when the emitted electrons collide with phosphor particles. The luminescence process is accompanied by the production of heat which may reduce the lifetime of the field emission lighting arrangement.

As a comparison and according to the invention, the field emission lighting arrangements is configured such that instead accelerating electrons towards the complete phosphor layer only selected portions of the phosphor layer are sequentially active to emit light, thereby for example allowing the selected portions of the anode layer to cool down before they are again activated. An advantage with the invention is thus that the lifetime of the field emission lighting arrangement may be increased, thereby possibly also reducing the lighting cost for the end user as the field emission lighting arrangement can be replaced at a lower rate.

The selected portions of the phosphor layer may comprise a large plurality of portions of the phosphor layer. Accordingly, the field emission lighting arrangement may thus be configured such that more than one selected portion is activated at one time and such that each of the large plurality of portions are activated according to a predefined scheme for sequentially activating the portions, for example using a power supply and control unit. The predefined scheme may of course also be random, as long as a single portion only is activated a part of the total time the complete phosphor layer is activated. Additionally, the portions of the phosphor layer may at least partly overlap.

In a preferred embodiment, the field emission lighting arrangement may also be arranged such that the selected portions are activated in a "sweep" manner. In such an embodiment, the field emission lighting arrangement may further comprise at least one gate electrode. The at least one gate electrode may be arranged to be activated such that the direction of electrons being emitted by the field emission cathode depends on a control voltage (with reference to a voltage potential applied to the field emission cathode) applied to the at least one gate electrode. The field emission arrangement may also comprise further gate electrodes.

The sequential activation of the portions of the phosphor layer is preferably taking place at a predetermined frequency. The predetermined frequency may for example depend on an emission decay of the phosphor layer. Generally, the emission decay for a phosphor layer suitable for a field emission arrangement takes place in a range of micro seconds thus indicating a "high" predetermined frequency. Taking into account the heat generated at the emission of light, the predetermined frequency is preferably selected to be above 10 kHz and preferably above 30 kHz.

Depending on the structure of the field emission lighting arrangement and once the choices of the cathode and anode materials are made, the configuration and the physical dimensions of the field emission lighting arrangement are determined; the physical properties of the field emission lighting arrangement may be determined. From the electric circuit point of view, some of these properties may be identified with those of electronic components, like a diode, capacitor and inductor with predetermined resistance, capacitance and inductance. The field emission lighting arrangement as a whole therefore manifests like these components in different ways, most importantly a resonance circuit under different driving conditions, such as DC, driving, "low" frequency driving and resonance frequency driving. Any frequency below the resonance frequency is defined as low frequency. By adjusting the capacitance and/or inductance inside and/or outside the lamp, it is possible to choose a desired resonance frequency and a phase relation between the input voltage and the current. This is further disclosed in EP09180155 by the applicant, which is incorporated by reference in its entirety. Accordingly, it may be preferred to select the predetermined frequency such that it is within a range corresponding to the half power width at resonance of the field emission lighting arrangement.

Preferably, the field emission cathode and the anode structure are both arranged inside of an evacuated envelop. Furthermore, the anode structure is preferably configured to receive electrons emitted by the field emission cathode when a voltage is applied between the anode structure and the field emission cathode and to generate light. The anode structure may be transparent and thus allow light to pass though the anode structure and out of the envelope, or reflective and thereby reflect the generated light out of the envelope. Additionally, the envelope is preferably of glass and the drive voltage is preferably in the range of 2-12 kV. Furthermore, the power supply may be electrically connected or in physical contact to the field emission arrangement, such as for example within a socket/base/side in the case the field emission arrangement is a field emission light source or placed in the vicinity of the field emission arrangement.

According to another aspect of the invention there is provided a field emission lighting system, comprising a first and a second field emission light source and a power supply and control unit connected to the first and the second field emission light source and configured to provide a drive signal for powering the first and the second field emission light source, wherein the power supply and control unit is further configured to provide the drive signal for sequentially power the first and the second field emission light source.

As stated above, the field emission lighting system comprises a first and a second light source and is configured such that each of the first and the second light source is sequentially activated for emitting light. As discussed and indicated above, by only activating one light source only a part of a total time it may be possible to increase the lifetime of the field emission lighting system as well as taking into account the positive effect of the emission decay of a phosphor layer of each of the field emission light sources, thereby possibly also reducing the lighting cost for the end user as the field emission lighting system can be replaced at a lower rate. The field emission lighting system may of course comprise more than two field emission light sources, possibly sequentially activated each at a time or a plurality at a time.

Additionally, the inventive concept may also be applicable using a plurality of individually controllable field emission cathodes providing similar advantages as discussed above.

Also, the lighting system may be compactly integrated as a single component, e.g. as a luminaire for lighting, or as a backlight for a display. Additionally, the field emission lighting arrangement or system according to the invention may preferably forms part of any lighting requiring application, including for example a field emission display, an X-ray source.

It should furthermore be noted that the main control concept of the invention also may be applicable to other phosphor based "instantaneous startup" light sources.

Further features of, and advantages with, the present invention will become apparent when studying the appended claims and the following description. The skilled addressee realize that different features of the present invention may be combined to create embodiments other than those described in the following, without departing from the scope of the present invention.

BRIEF DESCRIPTION OF THE DRAWINGS

The various aspects of the invention, including its particular features and advantages, will be readily understood from the following detailed description and the accompanying drawings, in which.

DETAILED DESCRIPTION

Figure 1:
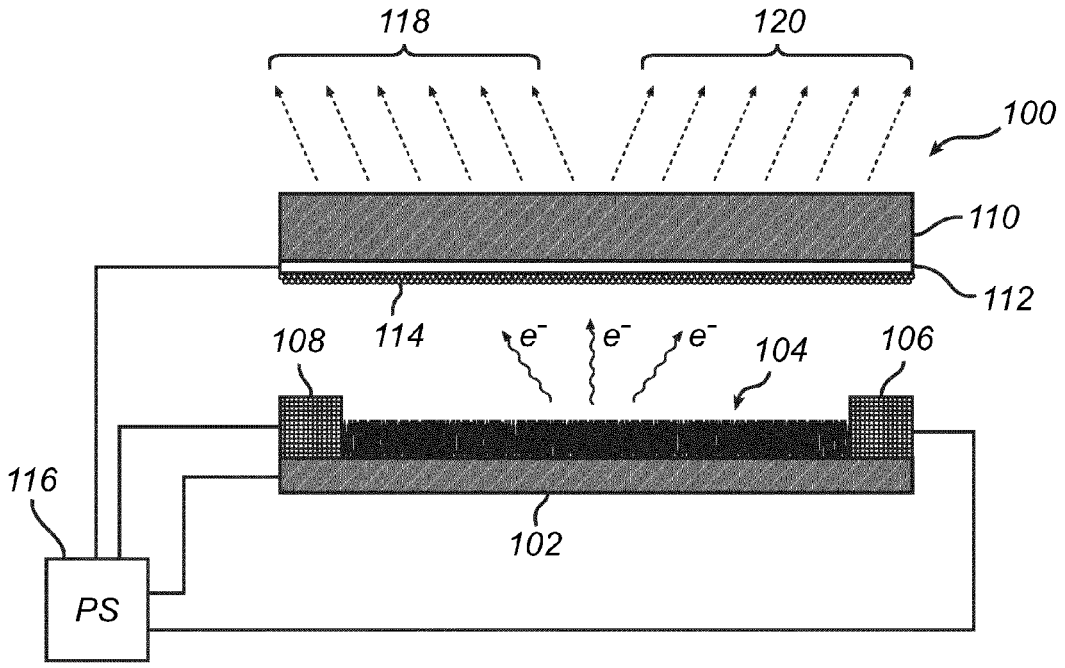
FIG. 1 illustrates a side view of a field emission lighting arrangement according to a currently preferred embodiment of the invention.

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled addressee. Like reference characters refer to like elements throughout.

Referring now to the drawings and to FIG. 1 in particular, there is depicted a side view of a field emission lighting arrangement 100 according to a currently preferred embodiment of the invention. The field emission lighting arrangement 100 comprises a substrate 102 onto which a plurality of sharp emitters has been provided, forming a field emission cathode 104. The sharp emitters may for example comprise ZnO nanostructures, including for example nano walls, nano tubes, etc. The sharp emitters may also comprise carbon based nanostructures. Adjacently to the field emission cathode 104 there is provided a first 106 and a second 108 gate electrode.

The field emission lighting arrangement 100 further comprises an out coupling substrate, for example in the form of a glass envelope 110 onto which there has been provided a transparent field emission anode, such as an ITO layer 112. For emission of light, a layer of phosphor 114 is provided on the inside of the ITO layer 102, facing the field emission cathode 104. The substrate 102 may be or may comprise means (e.g. electrically conductive) for allowing application of an electrical field between the field emission cathode 104 and the field emission anode, ITO layer 112 by means of a control unit and power supply 116. The field emission lighting arrangement 100 is further configured to allow connections between the gate electrodes 106, 108 and the control unit and power supply 116.

By application of the electrical field corresponding to the voltage range of 2-15 kV and during operation of the field emission lighting arrangement 100, the cathode 104 emits electrons, which are accelerated toward the phosphor layer 114. The phosphor layer 114 may provide luminescence when the emitted electrons collide with phosphor particles of the phosphor layer 114. Light generated at the phosphor layer 114 will transmit through the transparent ITO/anode layer 112 and the glass envelope 110. The light is preferably white, but colored light is of course possible. The light may also be UV light.

Additionally, by controlling the control unit and power supply 116 such that (in relation to the 2-15 kV provided between the anode 112 and cathode 104) a small potential difference is applied between the gate electrodes 106, 108 (in the ranged of hundreds of volts) and the field emission cathode 104 it is possible to adjust the emitted electrons and thus the portion of the phosphor layer 114 that generates light such that only selected portions of the phosphor layer 114 may be sequentially activated at a time.

By further allowing for individual control of the gate electrodes 106, 108 by means of the control unit and power supply 116 it is additionally possible to "sweep" the electron beam providing in the direction of the anode 112 such that for example the light may be emitted in the directions 118 or 120.

Figure 2:
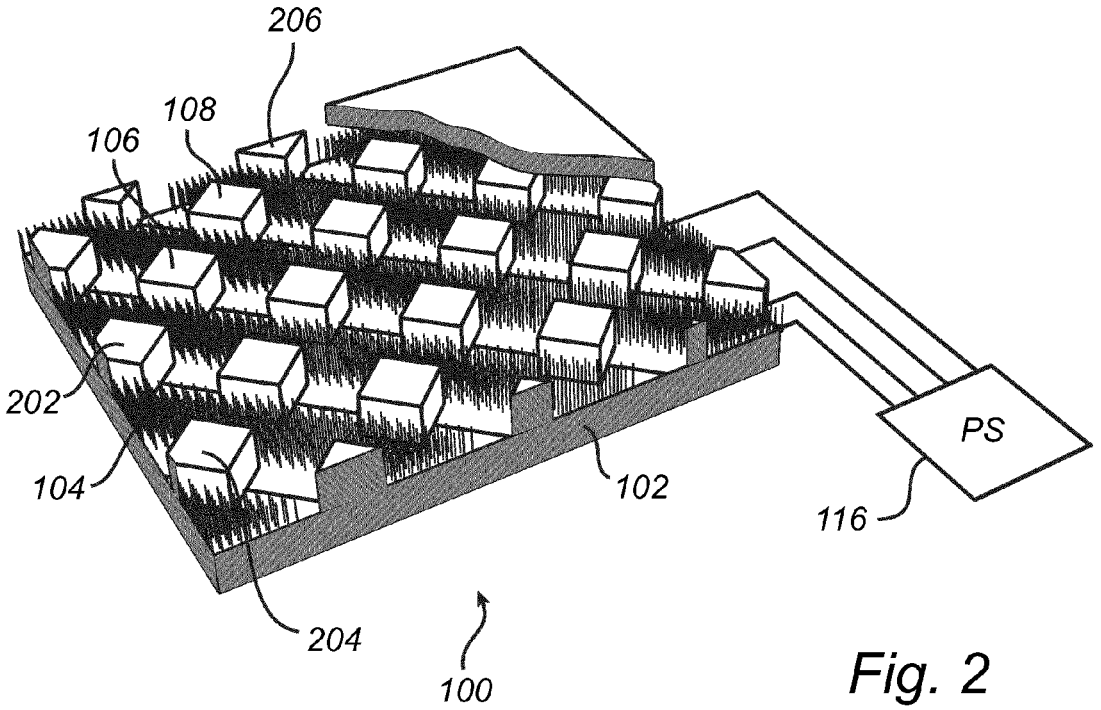
FIG. 2 illustrates a perspective view of a section of the field emission lighting arrangement shown in FIG. 1.

Turning now to FIG. 2, which illustrates a perspective view of a section of the field emission lighting arrangement shown in FIG. 1. Further to what is disclosed in FIG. 1, the perspective illustration indicates that the field emission lighting arrangement 100 may be provided in a flat form. The field emission lighting arrangement 100 may additionally comprises a large plurality of gate electrodes 106, 108, 202, 204 and 206 which may be "addressed" and controlled individually and/or in columns thereby further increasing the sectional and sequential activation possibility of the phosphor layer 114 and thus which portions of the phosphor layer 114 that will generate light.

Figure 3:
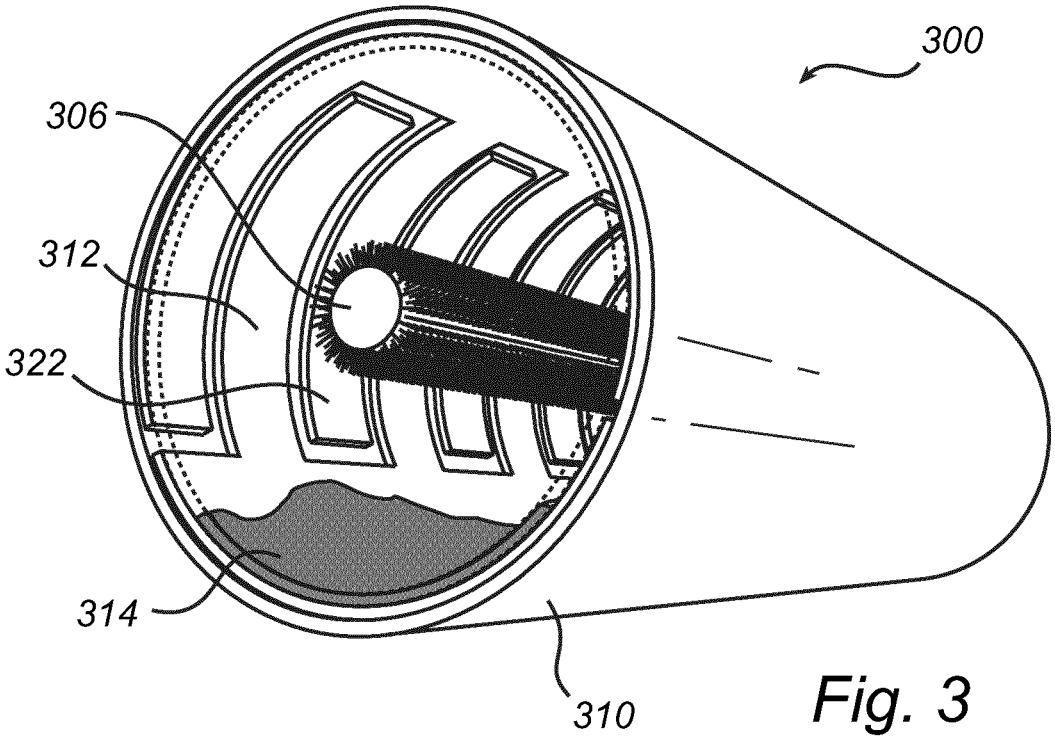
FIG. 3 illustrates an alternative field emission lighting arrangement according to the invention.

FIG. 3 illustrates an alternative field emission lighting arrangement 300 according to the invention, comprising a cylindrical glass envelope 310 inside of which a field emission cathode 306 is (e.g. centrally) arranged. The field emission cathode 306 may comprise a conductive substrate onto which a plurality of sharp emitters has been arranged, for example comprising ZnO nanostructures, including for example nano walls, nano tubes, etc. The sharp emitters may also comprise carbon based nanostructures (e.g. CNT etc.). For providing the possibility to sequentially activate selected portions of the phosphor layer 314, the functionality of the field emission anode, in FIG. 1 provided as the ITO layer 112, is provided as two separate field emission anodes 312, 322, respectively, each being individually controllable. The two separate field emission anodes 312, 322 may for example be arranged in a meander structure as indicated in FIG. 3.

Thus, during operation of the field emission lighting arrangement 300, the application of an electrical field for generating light may take place according to predetermined scheme, including applying the electrical field between the field emission cathode 306 and the field emission anode 312 in a first mode, between the field emission cathode 306 and the field emission anode 322 in another mode, and between the field emission cathode 306 and both of the field emission anodes 312 and 322 in a further mode, thereby allowing for the possibility to sequentially activate selected portions of the phosphor layer 314 for emitting light. It is of course possible to provide the field emission lighting arrangement 300 with more than two field emission anodes, including for example three or four field emission anodes.

Figure 4:
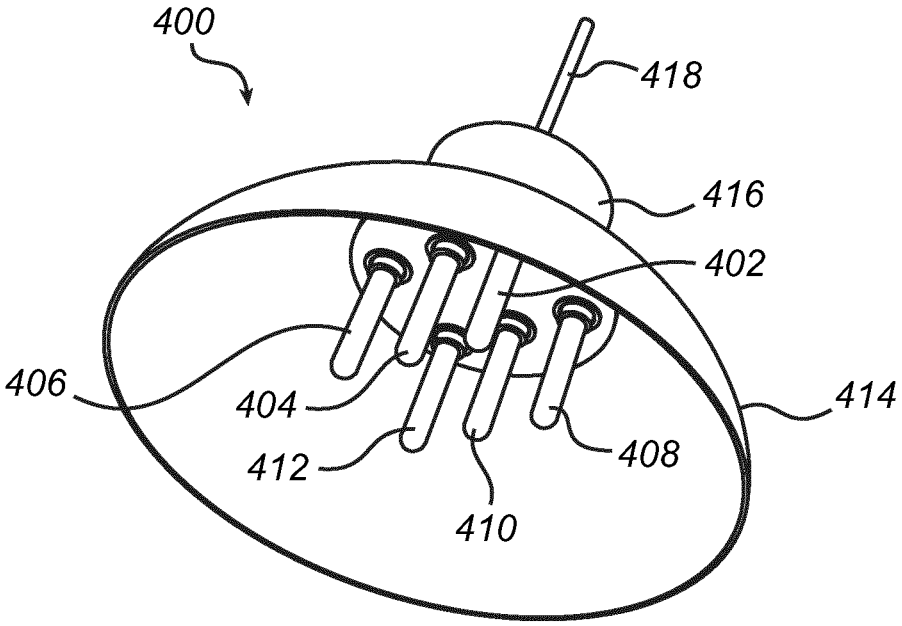
FIG. 4 provides a conceptual field emission lighting system according to an exemplary embodiment of the invention.

Turning finally to FIG. 4 which also provides an alternative embodiment of the invention provided as a field emission lighting system 400. The field emission lighting system 400 comprises a plurality of field emission light sources 402, 404, 406, 408, 410 and 412 arranged in a luminaire/reflector 414. Each of the field emission light sources 402, 404, 406, 408, 410 and 412 preferably comprises a field emission anode and a field emission cathode arranged in an evacuated envelope, where the field emission anode comprises a phosphor layer. The field emission lighting system 400 further comprise a control unit and power supply 416 for example arranged in the base of the luminaire/reflector 414 and being provided with an energy supply by means of the electrical connector 418 connected to the electrical mains.

During operation of the field emission lighting system 400, for example only one of the field emission light source 402, 404, 406, 408, 410 and 412 may be activated at a time by a drive signal of the control unit and power supply 416 for sequentially powering e.g. each of the field emission light source 402, 404, 406, 408, 410 and 412. The field emission light source 402, 404, 406, 408, 410 and 412 may also be activated according to a predetermined scheme where also a selected plurality of the field emission light source 402, 404, 406, 408, 410 and 412 are activated at one single time. As stated above, the drive signal from the control unit and power supply 416 may for example comprise a frequency component being selected based on an emission decay of the phosphor layer.

Even though the invention has been described with reference to specific exemplifying embodiments thereof, many different alterations, modifications and the like will become apparent for those skilled in the art. Variations to the disclosed embodiments can be understood and effected by the skilled addressee in practicing the claimed invention, from a study of the drawings, the disclosure, and the appended claims.

For example, the drive signal may have any suitable form, including for example AC, DC, pulsed DC or AC/DC with a controlled duty cycle. In a case where light is generated using a plurality of field emission light sources and/or a plurality of anodes, it may be suitable to apply a phase shifted drive signal, such that emission will take place slightly overlapping between the different anodes/light sources. Other types of drive signals are of course possible and within the scope of the invention.

Furthermore, in the claims, the word "comprising" does not exclude other elements or steps, and the indefinite article "a" or "an" does not exclude a plurality.

The invention claimed is:

1. A field emission lighting arrangement, comprising:

an anode structure at least partly covered by a phosphor layer;

a field emission cathode;

an evacuated envelope inside of which the anode structure and the field emission cathode are arranged;

a power supply and control unit, electrically connected to the anode structure and the field emission cathode and configured to provide a drive signal for powering the field emission arrangement; and wherein the drive signal comprises a control signal configured to sequentially activate selected portions of the phosphor layer for emitting light by controlling the direction of the electron emitted by the first emission cathode.

2. The field emission lighting arrangement of claim 1, wherein the selected portions of the phosphor layer at least partly overlap.

3. The field emission lighting arrangement of claim 1, wherein each of the portions of the phosphor layer are sequentially activated with a predetermined frequency.

4. The field emission lighting arrangement of claim 3, wherein the predetermined frequency is selected based on an emission decay of the phosphor layer.

5. The field emission lighting arrangement of claim 1, further comprising at least one gate electrode.

6. The field emission lighting arrangement of claim 5, wherein the anode structure is configured to receive electrons emitted by the field emission cathode and the at least one gate electrode is provided for controlling a direction of the electrons emitted by the field emission cathode.

7. The field emission lighting arrangement of claim 3, wherein the predetermined frequency is above 10 kHz.

8. The field emission lighting arrangement of claim 3, wherein the predetermined frequency is selected to be within a range corresponding to a half power width at resonance of the field emission lighting arrangement.

9. The field emission lighting arrangement of claim 1, further comprising at least a gate electrode provided for sequentially activating the selected portions of the phosphor layer.

10. The field emission lighting arrangement of claim 1, further comprising a plurality of individually controllable field emission cathodes.

11. The field emission lighting arrangement according to claim 1, wherein the control signal comprises a biased potential.

12. The field emission lighting arrangement according to claim 5, wherein the at least one gate electrode is arranged in electrical contact with the power supply and control unit, wherein the control signal is configured provide a bias to the at least one gate electrode.

13. The field emission lighting arrangement according to claim 1, further comprising a plurality of individually controllable anode structures, wherein the control signal is configured to bias at least one of the plurality of anode structures.

14. The field emission lighting arrangement according to claim 1, wherein the activation of selected portions of the phosphor layer is random.

* * * * *